US005666982A

United States Patent [19]

Pignon

[11] Patent Number: 5,666,982

[45] Date of Patent: Sep. 16, 1997

[54] BARRETTE MOUNT

[75] Inventor: Guy Pignon, Vouneuil Sous Biard, France

[73] Assignee: Etablissements Delsol, Paris, France

[21] Appl. No.: 358,007

[22] Filed: Dec. 16, 1994

[30] Foreign Application Priority Data

Dec. 20, 1993 [FR] France ..... 93 15284

[51] Int. Cl.[6] ..... A45D 8/22; A45D 8/28

[52] U.S. Cl. ..... 132/279; 132/276; 132/277; 132/278

[58] Field of Search ..... 132/273, 275, 132/276, 277, 278, 279

[56] References Cited

U.S. PATENT DOCUMENTS

| | | | |
|---|---|---|---|
| 2,921,589 | 1/1960 | Blomme | 132/279 |
| 3,805,813 | 4/1974 | Laughton | 132/279 |
| 5,062,436 | 11/1991 | Emsellem | 132/279 |
| 5,109,878 | 5/1992 | Kuo-Hwa | 132/278 |
| 5,259,405 | 11/1993 | Hoa-Chow | 132/279 |
| 5,365,955 | 11/1994 | Desgroux et al. | 132/279 |

FOREIGN PATENT DOCUMENTS

| | | |
|---|---|---|
| 0560672 | 9/1993 | European Pat. Off. . |
| 1121151 | 7/1956 | France . |
| 2170550 | 9/1973 | France . |
| 2527057 | 11/1983 | France . |
| 366279 | 1/1923 | Germany . |

*Primary Examiner*—Cary E. O'Connor
*Assistant Examiner*—Pedro Philogene
*Attorney, Agent, or Firm*—Young & Thompson

[57] ABSTRACT

A barrette mount includes a clamping member articulated to a main body and an attachment device for locking the clamping member to the main body. The attachment device includes a pair of lateral operating lugs projecting from the main body and each including a locking arm with a hook. The locking arms face towards each other and overlap partially. To enhance the opening of this type of attachment device an operating arm is provided to the rear of the attachment device. This operating arm extends from the rear edge of one lateral operating lug and towards the other lateral operating lug. The locking arms have either inclined or convexly rounded surfaces forming expulsion ramps.

17 Claims, 3 Drawing Sheets

BARRETTE MOUNT

BACKGROUND OF THE INVENTION

1. Field of the Invention

The present invention concerns a barrette mount of the kind including a main body and a clamping member articulated to the main body at one end. Its other end is adapted to hook onto attachment means provided on the main body, a spring being provided for ejecting the clamping member out of the attachment means.

The present invention is more particularly concerned with attachment means for this type of mount.

2. Description of the Prior Art

The attachment means most widely used for this type of mount comprise two lateral lugs which are bent parts of the main body, for example, having arms with hooks, said arms extending towards each other and partially overlapping. Patent FR-A-1 121 151 describes this type of attachment means.

In one embodiment the hooks are spaced from each other and face each other so as to define between them a hooking space for the longitudinal edges of a retaining lug at the end of the clamping member.

In another embodiment the hooks face in opposite directions and are adapted to cooperate with the edges of a cut-out at the end of the clamping member.

In both cases the clamping member is released by the user squeezing the lateral lugs together between the thumb and the index finger, so bending them towards the main body, the affect of which is either to move the hooks apart or to move them closer together, depending on the embodiment, until the end part of the clamping member is ejected out of the attachment means by the spring.

It has been realized that it would be of practical benefit to be able to open the barrette using operating means situated instead at the rear end of the attachment means.

Various solutions have been put forward, including patent U.S. Pat. No. 3,805,813 which describes a rear operating member constituted by the extension of a leaf spring beyond the area in which it is engaged with the main body. This operating member cooperates with inclined surfaces on the lateral lugs in such a manner as to move apart the hooks of the attachment means and eject the end part of the clamping member when the operating member is depressed towards the main body.

A completely different solution is described in document FR-A-2 527 057 and provides attachment means pivoting on lateral brackets and having a Z-shape profile with an upper part forming a rear operating tongue and an intermediate part with a longitudinal slot cooperating with a curved end part of the leaf spring and with a plane end part of the clamping member. When the operating tongue is depressed the attachment means are pivoted which inclines the slot to enable expulsion of the end part of the clamping member by the leaf spring.

Both these solutions have the disadvantage of requiring costly operations to manufacture and then to assemble a plurality of components and of requiring the use of a leaf spring which is independent of the mount.

Nowadays many barrette mounts are advantageously made in one piece and either by bending operations only or by injection molding.

A general object of the present invention is to improve the opening of attachment means including lateral operating lugs of the type described, for example, in document FR-A-1 121 151, complying with the requirements for cost-effective manufacture mentioned above.

SUMMARY OF THE INVENTION

The present invention consists in a barrette mount including a clamping member articulated to a main body and attachment means for locking said clamping member to said main body, said attachment means including a pair of lateral operating lugs projecting from said main body and each including locking arms with a hook, said locking arms being directed towards each other and partially overlapping, which mount further includes a rear operating arm extending from the rear edge of one of said lateral operating lugs towards the other lateral operating lug.

One of the lateral operating lugs of the attachment means is generally U-shape in plan view with one branch comprising a locking arm carrying a hook of the attachment means and the other branch comprising the rear operating arm.

In one preferred embodiment of the invention the component parts of the attachment means, lateral operating lugs and rear operating arm, are integral parts of the main body and are advantageously formed only by bending operations, in the manner of conventional attachment means.

In accordance with another feature of the invention a rear operating tongue extending generally parallel to the main body and towards the end of the latter is formed from the upper edge of the rear operating arm, preferably also by bending.

When pressure is applied to this rear operating tongue the lateral operating lug is caused to bend through the intermediary of the rear operating arm. This conjointly moves the locking arm and the hook that it carries and thereby releases the clamping member.

This enhances the opening of the attachment means, with the options of operating the attachment means in the conventional way by means of lateral lugs or in the new way by means of the rear end of the attachment means. In accordance with a further feature of the invention a rear operating arm is also formed from the rear edge of the other lateral operating lug to enable simultaneous movement of both hooks. To this end this second rear operating arm partially overlaps the first operating arm so that the rear operating tongue can bear against the upper edge of the second operating arm and so cause conjoint bending of the two lateral operating lugs.

In another aspect the present invention proposes a bar mount including a clamping member articulated to a main body and attachment means for locking said clamping member to said main body, said attachment means including a pair of lateral operating lugs protruding from said main body and each including a locking arm carrying at its end a locking finger with a hook, said locking arms being directed towards each other and overlapping partially and said hooks facing each other to enable hooking between them of the longitudinal outside edges of the clamping member, in which mount the longitudinal outside edges of said clamping member are also adapted to cooperate with two either inclined or convex rounded surfaces formed in said locking arms facing said hooks forming expulsion ramps.

The disposition of the expulsion ramps also enhances the opening of the attachment means.

In one embodiment of the invention the locking arms are generally U-shape, one branch of the U-shape being a locking finger carrying at its end a hook facing towards the other branch of the U-shape which has facing the hook an edge that is either inclined or convexly rounded to form an expulsion ramp.

The features and advantages of the invention will emerge more clearly from the following description of one embodiment of the invention given with reference to the appended drawings.

DETAILED DESCRIPTION OF THE PREFERRED EMBODIMENTS

Figure 1:
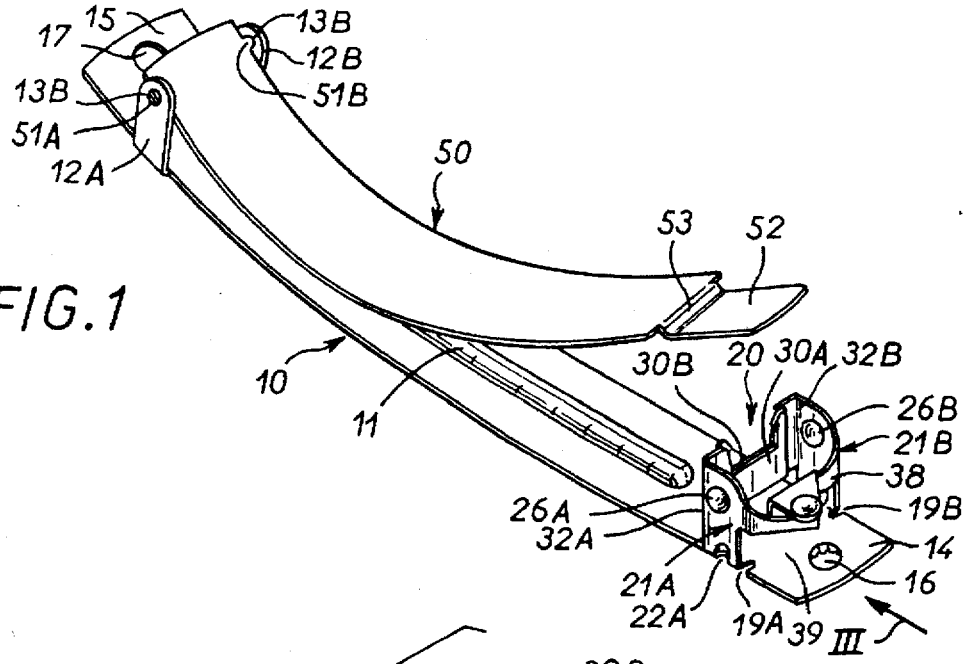
FIG. 1 is a perspective view of one embodiment of a barrette mount shown in the open position.

In the selected embodiment of the invention shown in FIGS. 1 to 4 the barrette mount includes a main body 10 with attachment means 20 onto which an articulated clamping member 50 hooks.

In a manner that is known in itself, the main body 10 is generally flat in shape with a stiffening rib 11 in the middle. Its end parts 14, 15 include inwardly stamped portions 16 and 17 for fixing any kind of decoration (not shown) to an outside surface of the main body.

Two lateral articulation lugs 12A, 12B are bent at right angles from the longitudinal edges of the main body 10 delimiting its end part 15. The lateral lugs 12A, 12B have at their rounded end a respective perforation 13A, 13B forming a bearing for respective journals 51A, 51B defining the articulation axis for the clamping member 50.

The clamping member 50 is a strip of elastic material curved on the side towards the main body to act as a return spring in the conventional manner that is known in itself. It has a narrower retaining lug 52 at the end which cooperates with the attachment means 20 and which is joined by a shoulder 53 to the remainder of the tongue.

For the following description of the attachment means 20, the term "rear" is chosen arbitrarily to apply to the end part 14 of the main body.

The attachment means 20 include a pair of facing lateral operating lugs 21A, 21B each bent from a respective opposite edge of the main body 10.

Forming the lugs 21A, 21B by bending is facilitated by the presence of a respective hole 22A, 22B in the bending area.

Figure 2:
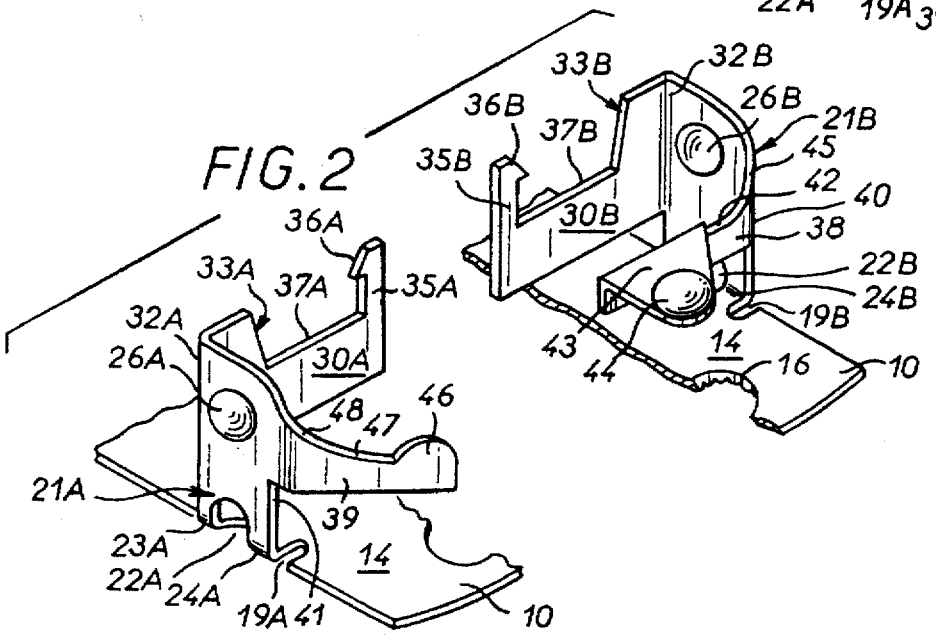
FIG. 2 shows part of FIG. 1 with two separate parts of the main body shown in longitudinal section so that the components of the attachment means can be seen more clearly.

Two bending lines 23A and 24A are thus formed on opposite sides of the hole 22A and likewise two bending lines 23B (not visible in the figures) and 24B are formed on opposite sides of the hole 22B (see FIG. 2).

The holes 22A, 22B also have the advantage of increasing the flexibility of the lateral lugs 21A, 21B which makes the attachment means work better. With the same end in view, notches 19A, 19B are formed in the main body 10 at the base of the rear edge of the lugs 21A, 21B in a general direction perpendicular to the bending lines 23A, 24A, 23B and 24B.

Bosses 26A, 26B formed in the upper part of the lateral lugs 21A, 21B provide operating buttons.

The part of the attachment means for locking the retaining lug 52 of the clamping member 50 comprises two locking arms 30A, 30B directed towards each other and partially overlapping. These arms are joined by a right-angle bending line 32A, 32B.

Figure 3:
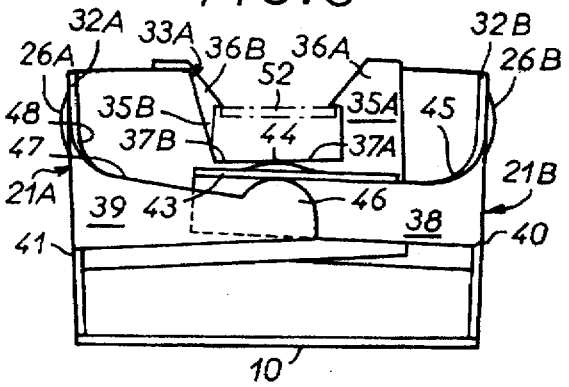
FIGS. 3 and 4 are elevation views in the direction of the arrow III in FIG. 1 showing how the attachment means work.

Each locking arm 30A, 30B incorporates a cut-out with a respective hook 36A, 36B, the two hooks facing each other and cooperating with each other to form a hooking housing for the retaining lug 52 (see FIG. 3).

As can be seen more clearly in FIG. 2, this cut-out is generally U-shape with an inclined edge (33A, 33B) at a distance from the bending line (32A, 32B), a central edge (37A, 37B) at an obtuse angle to the inclined edge (33A, 33B), and a locking finger (35A, 35B) which extends in a general direction parallel to the bending line (32A, 32B) and has a head forming a hook (36A, 36B) on the edge of the cut-out.

The inclined edges 33A and 33B of the arms 30A, 30B form ramps facilitating expulsion of the retaining lug 52.

In accordance with the invention, operating means for opening the attachment means are provided to the rear of the latter. They comprise two rear operating arms 38 and 39 which extend towards each other and partially overlap.

The rear operating arm 38 is joined by a bending line 40 to the rear edge of the lateral lug 21A in the upper half of the latter. The upper edge 42 of the operating arm 38 has a curved portion 45 extending towards the upper edge of the lateral lug 21B. At the end of the edge 42 a rounded operating lug 43 is formed by a right-angle bend. The lug 43 extends towards the rear of the mount parallel to the main body 10. A boss 44 is formed on the upper surface of the tongue 43 at its rounded end.

The rear operating arm 39 is joined by a bending line 41 to the rear edge of the lateral lug 21A in the upper part of the latter. Its upper edge 47 has a curved portion 48 extending towards the upper edge of the lateral lug 21A. At the end of the operating arm 39 is a rounded projection 46 in the same plane as said arm. Referring to FIG. 1, the rounded projection 46 is located so that it is disposed under the operating tongue 43.

Note that the rear operating arms 38 and 39 can advantageously be disposed as far away as possible from the root area by bending the corresponding lateral lugs 21B and 21A to maximize the lever effect on bending of the latter.

The shape of the rear operating arms 38 and 39 with the curved portions 45 and 48 on their upper edges 42 and 47 also enhances the bending of the lateral lugs.

The operation of the attachment means is described next with more particular reference to FIGS. 3 and 4.

FIG. 3 shows the barrette mount closed with the retaining tongue 52 engaged with the hooks 36A, 36B of the attachment means.

Figure 4:
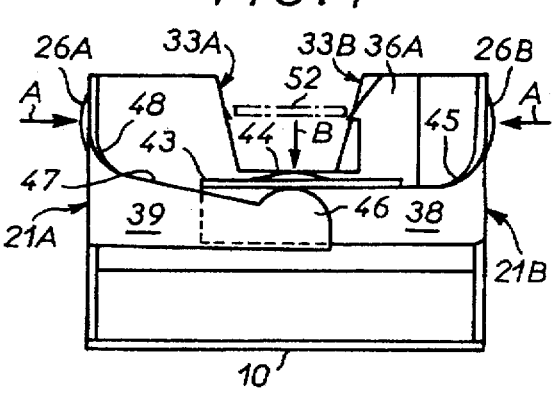

FIG. 4 shows both ways of opening the attachment means. The first, known in itself, consists in applying pressure to the lateral operating lugs 21A, 21B in the direction of the arrows A: the hooks 36A and 36B move apart and open a passage for the tongue 52 which is ejected by the clamping member 50 acting as a return spring and guided by the expulsion ramps formed by the inclined edges 33A, 33B of the locking arms 30A, 30B.

The second way is to cause the lateral operating lugs 21A, 21B to bend through the intermediary of the operating tongue 43 at the rear of the attachment means: if the operating tongue 43 is pressed towards the main body 10, in the direction of the arrow B (see also FIG. 4), the latter automatically depresses the projection 46 on the rear operating arm 39, which causes the lateral operating lugs 21A and 21B to bend which displaces the hooks 36A and 36B.

The angle between the lug 21A and the rear operating arm 39 is an obtuse angle to combine maximum action of the tongue 43 with minimum bending.

Note that in the embodiment of the invention just described, bending of the lugs 21A, 21B is facilitated by the notches 19A, 19B in the main body 10, by the holes 22A and 22B at the base of the lateral operating lugs 21A, 21B and by the disposition of the operating arm 38 in the upper part of the edge of the lug 21B.

Other ways of favoring bending of the lateral operating lugs are feasible.

Figure 5:
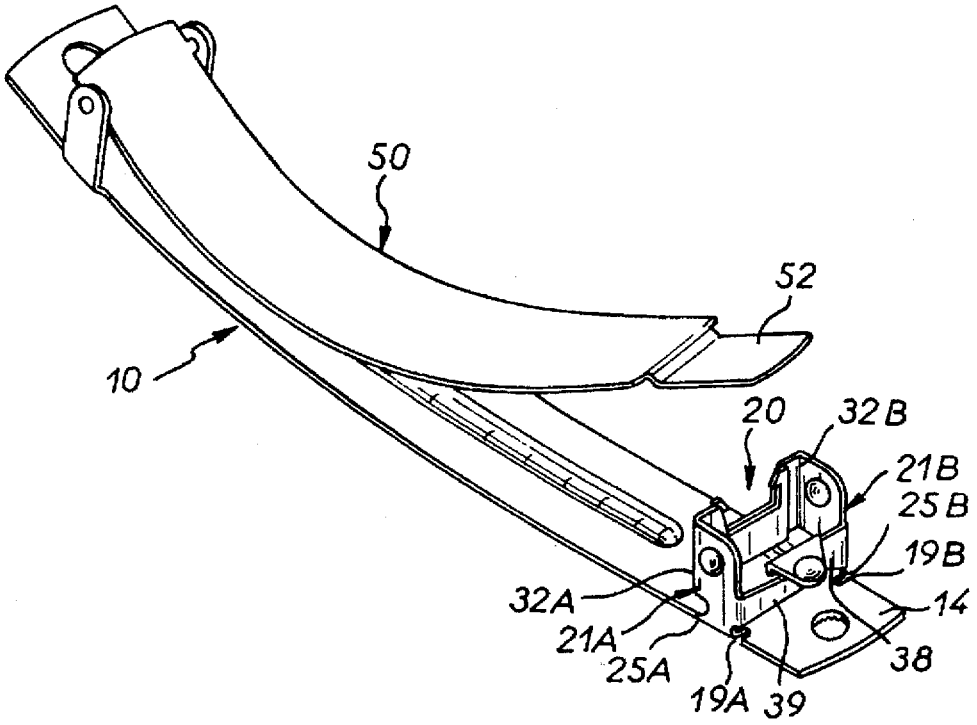
FIGS. 5 and 6 show an alternative embodiment of the attachment means.
Figure 6:
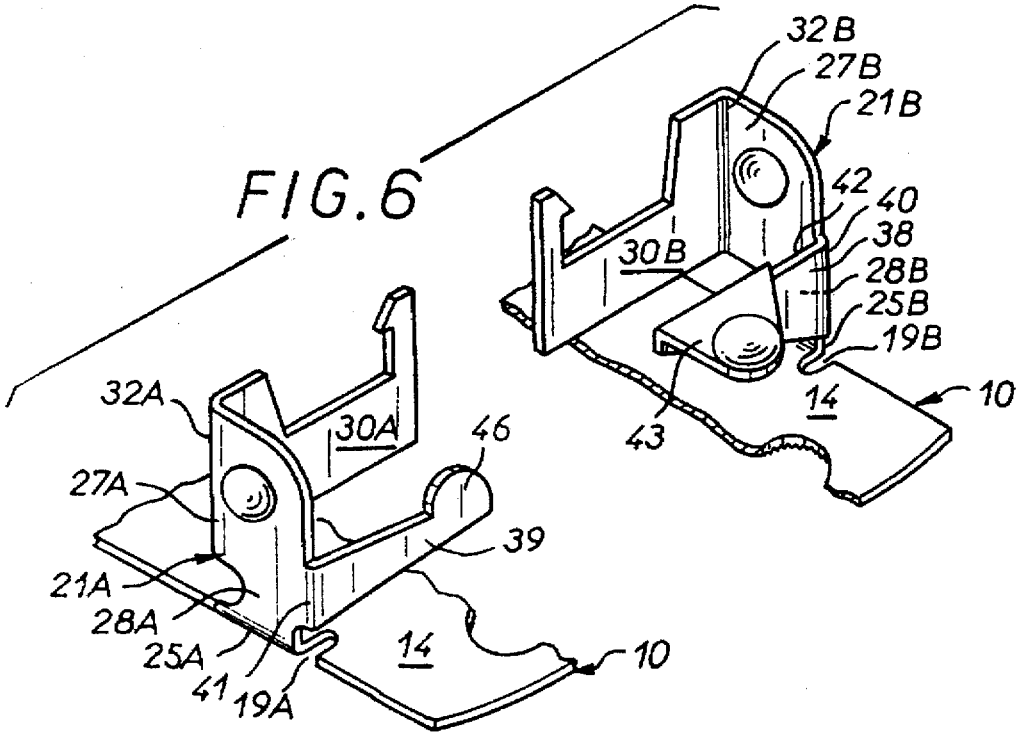

For example, FIGS. 5 and 6 show an alternative embodiment of the attachment means with a different conformation of the lateral operating lugs 21A, 21B.

Similar parts of the mount are identified by the same reference numbers as used in FIGS. 1 and 2.

In this embodiment the lateral operating lugs 21A, 21B are each connected to the main body 10 by a respective right-angle bending line 25A, 25B. To increase flexibility about these bending lines 25A, 25B the lateral operating lugs 21A, 21B are substantially L-shape with one end part of the L-shape, respectively 27A, 27B extending towards the front of the attachment means and the other end part of the L-shape constituting a respective offset foot 28A, 28B towards the rear of the attachment means (see FIG. 6). The front edge of the feet 28A, 28B widens slightly towards the main body 10. The rear edge is straight. The notches 19A, 19B in the main body 10 are at the base of this rear edge.

It goes without saying that other embodiments of the invention are feasible, in particular with regard to the articulation of the clamping member 50, which could be constituted by a bending line, in which case all of the mount can advantageously be made in one piece. Means other than the stamped areas 16 and 17 for attaching decorative members could also be used.

With regard to the arrangement conferring flexibility on the lateral lugs 21A, 21B, it goes without saying that the holes 22A, 22B could be above the bending area. It would also be feasible to dispense with the notches 19A, 19B in the main body.

Also, the attachment means could be of the type including hooks facing away from each other and cooperating with the edges of a cut-out in the end portion of the clamping member.

Figure 7:
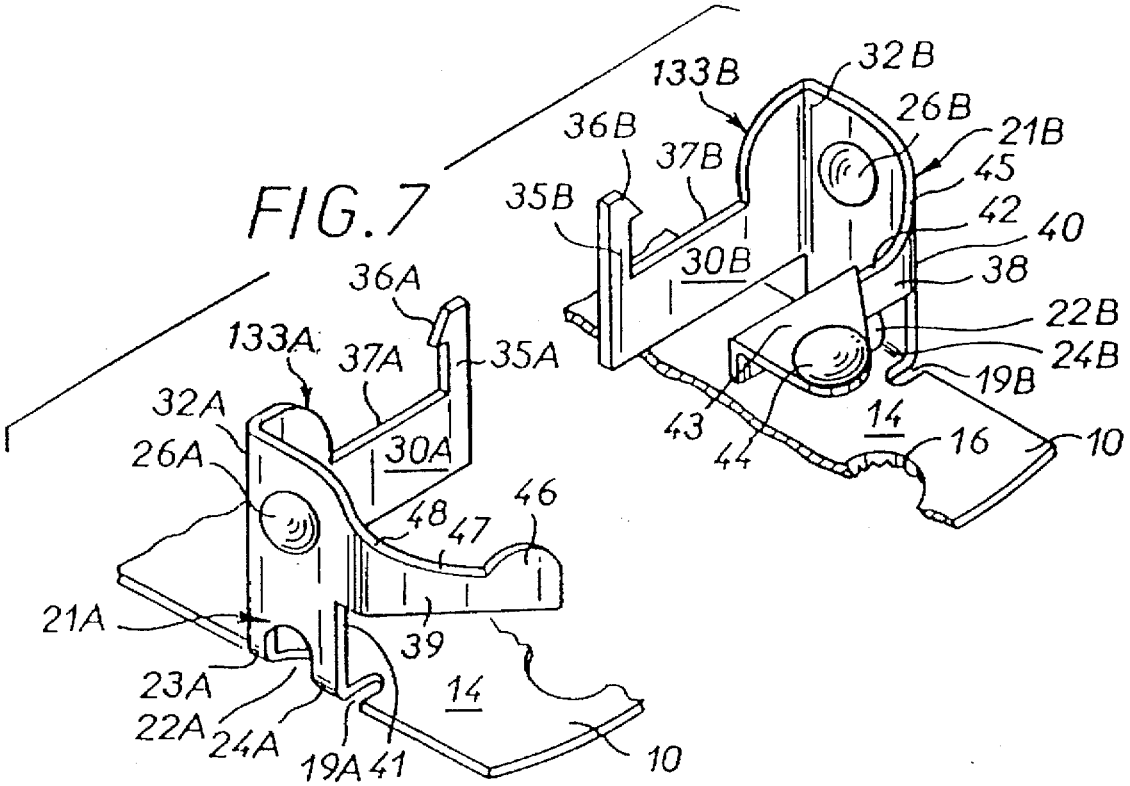
FIG. 7 corresponds to FIG. 2 and illustrates a variant embodiment of the expulsion ramps.

In the embodiments described expulsion ramps are provided by the inclined edges 33A, 33B. This function could instead be implemented by means of convexly rounded edges. Such a variant is illustrated in FIG. 7 which as in all other respects is identical to FIG. 2. Convexly rounded edges 133A and 133B respectively defined on arms 30A 30B facilitate expulsion of the retaining lug There is claimed:

1. Barrette mount comprising a clamping member articulated to a main body and attachment means for locking said clamping member to said main body, said attachment means including a pair of lateral operating lugs projecting from said main body and each including a locking arm with a hook, said locking arms being directed towards each other and partially overlapping, said mount comprising a rear operating arm extending from a rear edge of one of said lateral operating lugs towards the other lateral operating lug.

2. Mount according to claim 1 wherein a rear operating tongue extends from an upper edge of said rear operating arm towards a rear end of said main body and parallel to the latter.

3. Mount according to claim 2 wherein another rear operating arm is provided, starting from a rear edge of the other lateral operating lug, said two rear operating arms overlapping at least partially.

4. Mount according to claim 3 wherein said rear operating arm and said lug to which it is attached are at an angle to each other of 90° or greater.

5. Mount according to claim 3 wherein said rear operating arm has a projection disposed under said rear operating lug.

6. Mount according to claim 1 wherein said hooks face each other to enable hooking between them of a lug at the end of said clamping member.

7. Mount according to claim 1 wherein said hooks face each other and are adapted to cooperate with a cut-out in an end portion of said clamping member.

8. Mount according to claim 6 wherein each of said locking arms includes a cut-out having an inclined edge, a central edge and a locking finger which extends along a general direction parallel to a bent edge of the corresponding lateral lug with a head forming a hook, said inclined edge forming an expulsion ramp.

9. Mount according to claim 6 wherein said locking arms including a cut-out having a convexly rounded edge, a substantially horizontal central edge and a locking finger which extends in a general direction parallel to a bent edge of the corresponding lateral lug with a head forming a hook, said convexly rounded edge forming an expulsion ramp.

10. Mount according to claim 1 wherein said operating arms are as far as possible from a root area on said main body of the corresponding lateral operating lugs.

11. Mount according to claim 1 made in one piece and exclusively by bending operations.

12. Mount according to claim 1 wherein said lateral operating lugs include a hole in a bending area where the lugs merge with said main body or above the bending area.

13. Mount according to claim 1 wherein said lateral operating lugs are substantially L-shape and oriented with one end part of said L-shape extending towards a front portion of said attachment means and the other end part of said L-shape constituting an offset foot disposed towards a rear portion of said attachment means.

14. Bar mount including a clamping member articulated to a main body and attachment means for locking said clamping member to said main body, said attachment means including a pair of lateral operating lugs protruding from said main body and each including a locking arm carrying at its end a locking finger with a hook, said locking arms being directed towards each other and overlapping partially and said hooks facing each other to enable hooking between them a the longitudinal outside edges of said clamping member, the longitudinal outside edges of said clamping member being also cooperable with two surfaces formed in said locking arms facing said hooks and defining expulsion ramps for guiding the clamping member when released by said hooks.

15. Mount according to claim 14 wherein said locking arms are generally U-shape, one branch of said U-shape being a locking finger carrying at its end a hook directed towards the other branch of said U-shape which has facing said hook an edge forming said expulsion ramp.

16. Mount according to claim 14, wherein said ramps are inclined surfaces.

17. Mount according to claim 14 wherein said ramps are convexly rounded surfaces.

* * * * *